United States Patent [19]

Harvey et al.

[11] Patent Number: 4,766,345

[45] Date of Patent: Aug. 23, 1988

[54] GAS DISCHARGE DISPLAY PANEL HAVING NOVEL CATHODE ASSEMBLY

[75] Inventors: Edgar L. Harvey, Jamesburg; Joseph Lippencott, Somerset, both of N.J.

[73] Assignee: Telegenix, Inc., Cherry Hill, N.J.

[21] Appl. No.: 51,588

[22] Filed: May 20, 1987

[51] Int. Cl.[4] ..... H01J 61/66

[52] U.S. Cl. ..... 313/518; 313/517; 315/169.4; 340/759

[58] Field of Search ..... 313/518, 517, 514, 519; 340/756, 758, 759, 769, 771, 775, 779

[56] References Cited

U.S. PATENT DOCUMENTS

| | | | |
|---|---|---|---|
| 3,760,403 | 9/1973 | Kippenhan | 340/758 |
| 4,019,086 | 4/1977 | Person et al. | 313/518 |
| 4,135,117 | 1/1979 | Dubois | 340/758 |
| 4,167,005 | 9/1979 | Beauviala | 340/756 X |

FOREIGN PATENT DOCUMENTS

| | | | |
|---|---|---|---|
| 2230553 | 1/1974 | Fed. Rep. of Germany | 313/517 |

*Primary Examiner*—David K. Moore
*Assistant Examiner*—Michael Horabik
*Attorney, Agent, or Firm*—Robert A. Green

[57] ABSTRACT

A cold cathode gas discharge display panel comprising a gas-filled envelope including a glass base plate and glass face plate. An array of linear electrodes are provided on the base plate with some of the cathodes having adjacent ends. The usual masking layer of insulating material is provided on the base plate to outline the cathodes but this insulating layer does not cover the adjacent ends of the cathodes so that these ends are operatively disposed close together. Thus an improved glow blending of adjacent cathode ends is achieved.

6 Claims, 1 Drawing Sheet

GAS DISCHARGE DISPLAY PANEL HAVING NOVEL CATHODE ASSEMBLY

BACKGROUND OF THE INVENTION

One type of cold cathode gas discharge display device which has been known and available commercially for many years is known generically as a segment type device. This type of device includes one or more groups of cathodes, each group including a plurality of cathode electrodes in the form of linear segments usually arrayed in a figure "8" pattern and a display is provided by energizing one or more cathodes to form the desired character. In manufacturing segment-type display devices, particularly flat panels, the cathode segments are formed on the panel base plate and then they are outlined completely with a layer of insulating material. This is done to provide sharply outlined segments.

Because the cathodes are completely outlined, the adjacent uncoated ends of two separate segments must necessarily be spaced apart a distance determined by the coating of insulating material. Under some circumstances, this spacing is so large that continuous cathode glow is not achieved between these adjacent ends and the glowing character does not have an aesthetically pleasing appearance or what is worse, a false display may occur.

The present invention overcomes the above-described problem by providing the cathode-outlining layer but by not outlining the immediately adjacent ends of the cathodes in a group. Although segment-type display panels have been made for many years, this expedient has never been used or suggested.

DESCRIPTION OF THE INVENTION

Figure 1:
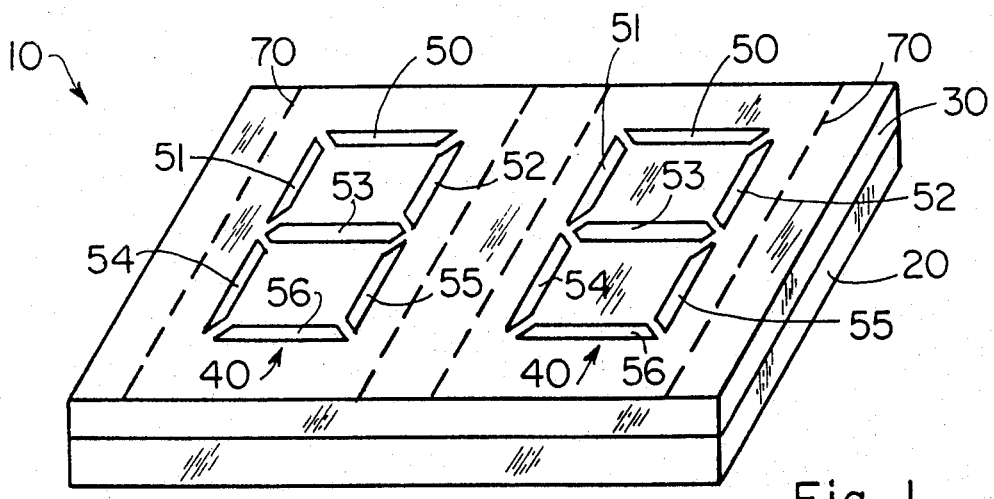
FIG. 1 is a perspective view of a schematic representation of a segment-type display panel.

A segment-type cold cathode display panel 10 embodying the invention is shown in FIG. 1 in schematic form and only the portions thereof necessary to describe the invention are shown and described herein. Panels of this type are well known in the art and they have been commercially available for many years. There are also many patents and publications which describe such panels. Thus, all of the details of construction and manufacture need not be described herein for those skilled in the art to understand the invention.

Display panel 10 includes a gas-filled envelope made up of a glass base plate 20 and a glass face plate 30 which are hermetically sealed together along their aligned peripheries. In the panel, 10, the base plate carries one or more groups 40 of cathode electrodes each of which includes an array of cathode electrode segments 50, 51, 52, 53, 54, 55 and 56 disposed in a figure "8" pattern. In making the panel, conductive runs (not shown) are provided on the base plate and are connected to the cathodes so that external electrical connection can be made thereto. This is well known in the art.

Figure 2:
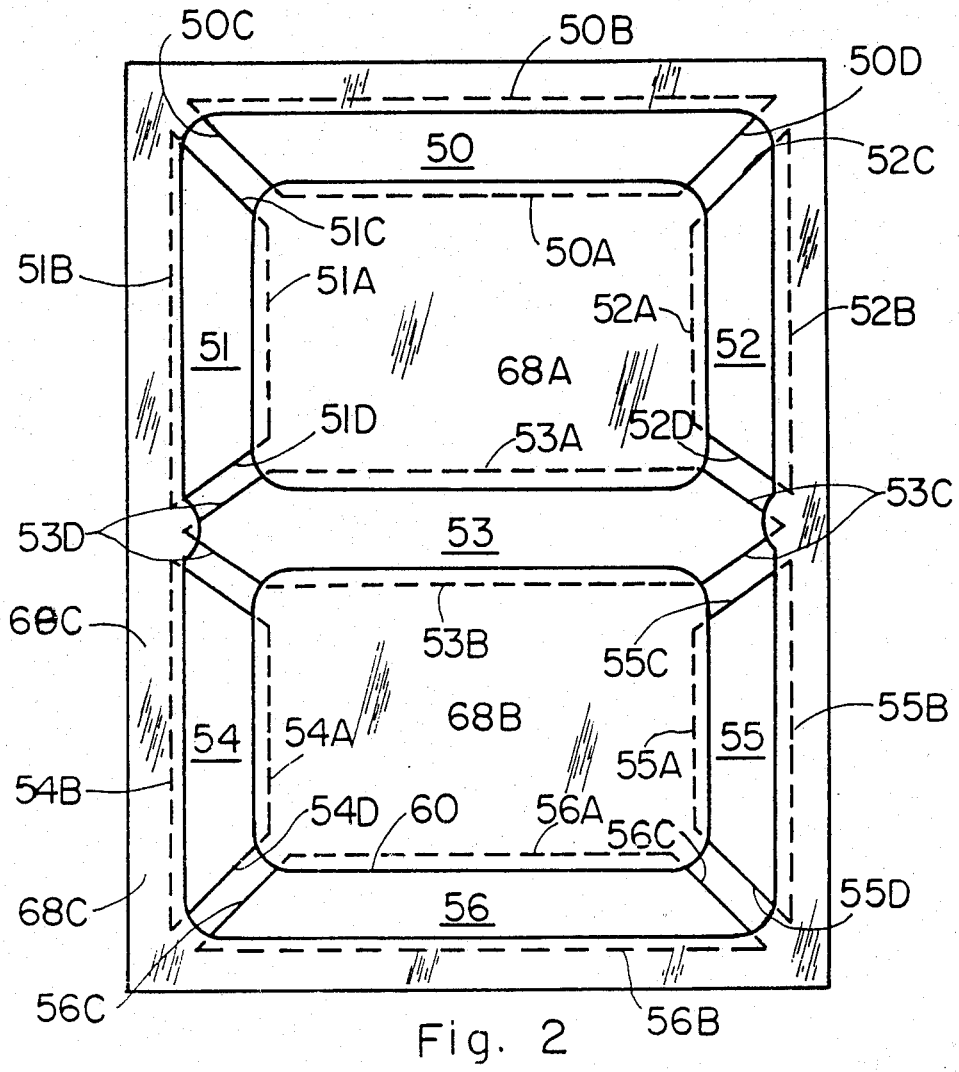
FIG. 2 is a plan view of one group of cathode segments employing the invention and showing the panel base plate assembly before the face plate assembly has been coupled thereto.

Referring to FIG. 2, wherein the principles of the invention are illustrated, the cathode segments 50 to 56 are formed by a screening process on the base plate in proper contact with their conductive runs. The cathodes are linear in form and they have long sides and ends. Cathode 50, for example, has long sides 50A and 50B and ends 50C and 50D. The ends of the cathodes are complementarily slanted so that adjacent ends are parallel to each other. The corresponding parts of the other cathodes are similarly numbered as shown in FIG. 2.

After the cathodes have been formed on base plate 20, a layer of insulating material including portions 68A, 68B and 68C is provided to outline the cathodes. It can be seen that with the ends of adjacent cathodes complementarily slanted they can be positioned close to each other with a spacing of as little as 10 mils being achievable by means of the invention. According to the invention, in order to achieve this spacing between the ends of adjacent cathodes, a spacing which was not achievable in the past, the layer of insulating material 68A is formed so that it extends along the long sides A of the cathodes 50, 51, 52 and 53 and covers these edges or sides of the cathodes. However, the insulating material 68A is not present between all of the adjacent ends of the cathodes. Insulating layer 68B similarly covers the long sides A of cathodes 53, 54, 55 and 56. Thus there are two inner rectangular areas of insulating material 68A and 68B which overlay the long side edges A of cathodes 50, 51, 52 and 53 and the spaces between them and an angular area of insulating material 68C which overlays long side edges B of the cathodes 50, 51, 52 54, 55 and 56 and portions of the end tips of cathode 53 to achieve the proper shape of the area of cathode 53.

It is noted that the ends C and D of the cathodes are uncoated and adjacent ends can thus be positioned close to each other.

Insulating material 68 also covers all of the base plate between adjacent groups of cathodes.

After the cathodes have been formed and coated, the face plate 30 carrying a transparent conductive anode 70 (FIG. 1) for each group of cathodes is sealed to the base plate and the envelope is filled with ionizable gas and the panel is otherwise processed to completion.

In operation of the panel 10, when cathodes are energized, the glow readily fills the space between the closely spaced ends of adjacent cathodes to provide an aesthetically pleasing appearance to the character formed by the cathodes.

What is claimed is:

1. A cold cathode gas discharge display panel comprising an envelope made up of a glass base plate and a glass face plate hermetically sealed together, the envelope being filled with an ionizable gas capable of sustaining cathode glow, a plurality of cathode electrodes disposed on said base plate and arrayed in a pattern such that the cathodes can be energized and caused to glow in different groups to represent different characters, said cathodes each comprising a body of glowable material having a continuous periphery including an edge portion, the edge portion of one cathode lying adjacent to an edge portion of another adjacent cathode whereby when said one cathode and said another adjacent cathode are energized and caused to glow, the glow at said edge portions tend to connect the glows of the two cathodes together, a layer of insulating material extending along and overlying a portion of the perhiphery of each cathode except the edge portion thereof whereby said cathodes can be positioned with their edge portions positioned optimally close together to provide continuous glow between the edge portions of two adjacent cathodes which are energized and caused to glow at the same time, and anode electrode means in said envelope operable with the cathode electrodes therein to cause cathode glow.

2. The panel defined in claim 1 wherein said cathodes are linear in form and each cathode has two long sides and two end edges, and said layer of insulating material overlays the long sides of each cathode but not the end edges thereof whereby the end edges of adjacent cathodes can be positioned close to each other and continuous cathode glow from cathode to cathode can be readily formed across the ends of the adjacent cathodes.

3. The panel defined in claim 2 wherein said cathodes have long axes and the end edges of said cathodes are slanted at an angle with respect to the long axes, the end edges of adjacent cathodes being close to and parallel to each other.

4. A cold cathode gas discharge display device comprising an envelope made up of a glass base plate and a glass face plate hermetically sealed together, the envelope being filled with an ionizable gas capable of sustaining cathode glow, a plurality of cathode electrodes disposed on said base plate and arrayed in a figure 8 pattern wherein a first group of cathodes contains an upper cathode, left and right side cathodes and a center cathode and a second group of cathodes contains a lower cathode, left and right side cathodes and said center cathode, said plurality of cathode electrodes being linear in form, with each cathode having two parallel long edges and two end edges, each cathode having each of its end edges adjacent to an end edge of an adjacent cathode and, for each cathode, one long edge is an inner edge of the figure 8 pattern and one long edge is an outer edge of the figure 8 pattern, a first layer of insulating material extending along, overlying and covering a narrow strip of the long inner edges of one group of cathodes, but not covering the end edges, a second layer of insulating material extending along, overlying and covering a narrow strip of the long inner edges of the other group of cathodes, but not covering the end edges, and an annular layer of insulating material enclosing all of said cathodes and overlying and covering a narrow strip of the outer long edges of all of said cathodes except said center cathode, each of said cathodes having an uncoated glowable portion at the end edges between each of said first and second layers of insulating material and said annular layer of insulating material, and anode electrode means in said envelope operable with said cathode electrodes to provide continuous glow between the adjacent end edges of adjacent cathodes.

5. A cold cathode gas discharge display device comprising an envelope made up of a glass base plate and a glass face plate hermetically sealed together, the envelope being filled with an ionizable gas capable of sustaining cathode glow, a plurality of cathode electrodes disposed on said base plate and arrayed in a pattern such that cathodes can be energized in different groups and caused to glow in different groups to represent different characters, said cathodes being linear in form, with each cathode having two parallel long edges and two end edges, each of its end edges being adjacent to an end edge of an adjacent cathode, a first layer of insulating material extending along and overlying and covering a narrow strip of a long edge of each cathode but not covering the end edges, and a layer of insulating material extending along and overlying and covering a narrow strip of the other long edge of each cathode but not covering the end edges thereof whereby each cathode has its end edges uncoated and capable of glowing, the end edges of adjacent cathodes being positioned close to each other so that when two adjacent cathodes glow, the glowing end edges merge and provide continuous glow between said adjacent cathodes, and anode electrode means in said envelope operable with the cathode electrodes therein to cause cathode glow.

6. A cold cathode gas discharge display device comprising an envelope made up of a glass base plate and a glass face plate hermetically sealed together, the envelope being filled with an ionizable gas capable of sustaining cathode glow, a plurality of cathode electrodes disposed on said base plate and arrayed in a pattern such that cathodes can be energized in different groups and caused to glow in different groups to display different characters, said cathodes being linear in form, with each cathode having two parallel long edges and two end edges, each cathode having each of its end edges adjacent to an end edge of an adjacent cathode, and, for each cathode, one long edge is an inner edge of the pattern and one long edge is an outer edge of the pattern, a first layer of insulating material extending along and overlying and covering a narrow strip of the long inner edges of each cathode, but not covering the end edges, and a second layer of insulating material overlying and covering a narrow strip of the outer long edges of all of said cathodes, each of said cathodes having an uncoated glowable portion between each of said first and second layer of insulating material, and anode electrode means in said envelope operable with said cathode electrodes to provide continuous glow between adjacent end edges of adjacent cathodes.

* * * * *